US012808600B2

(12) United States Patent
Gaertner et al.

(10) Patent No.: US 12,808,600 B2
(45) Date of Patent: Nov. 24, 2026

(54) FACILITY AND METHOD FOR THE LIQUEFACTION OF HYDROGEN

(71) Applicant: L'Air Liquide, Societe Anonyme pour l'Etude et l'Exploitation des Procedes Georges Claude, Paris (FR)

(72) Inventors: Axelle Gaertner, Champigny-sur-Marne (FR); Bertille Guenego, Champigny-sur-Marne (FR); Pierre Barjhoux, Sassenage (FR); Florian Martin, Sassenage (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 416 days.

(21) Appl. No.: 18/577,513

(22) PCT Filed: Jun. 17, 2022

(86) PCT No.: PCT/EP2022/066597
§ 371 (c)(1),
(2) Date: Jan. 8, 2024

(87) PCT Pub. No.: WO2023/280549
PCT Pub. Date: Jan. 12, 2023

(65) Prior Publication Data

US 2024/0384926 A1 Nov. 21, 2024

(30) Foreign Application Priority Data

Jul. 8, 2021 (FR) ..... 2107411

(51) Int. Cl.
*F25J 1/00* (2006.01)
*F25J 1/02* (2006.01)

(52) U.S. Cl.
CPC ..... *F25J 1/001* (2013.01); *F25J 1/0042* (2013.01); *F25J 1/005* (2013.01); *F25J 1/0052* (2013.01);
(Continued)

(58) Field of Classification Search
CPC ..... F25J 1/001; F25J 1/0205; F25J 2245/02; F25J 2230/08; F25J 2290/62
See application file for complete search history.

(56) References Cited

U.S. PATENT DOCUMENTS 6,085,546 A * 7/2000 Johnston ..... F25J 1/004 62/619
11,073,245 B2 * 7/2021 Bernhardt ..... F17C 6/00
(Continued)

FOREIGN PATENT DOCUMENTS

| | | |
|---|---|---|
| EP | 3 650 741 | 5/2020 |
| EP | 3 764 047 | 1/2021 |
| FR | 2 663 714 | 12/1991 |

OTHER PUBLICATIONS

International Search Report and Written Opinion for PCT/EP2022/066597, mailed Sep. 29, 2022.
(Continued)

*Primary Examiner* — Brian M King
(74) *Attorney, Agent, or Firm* — Justin K. Murray

(57) ABSTRACT

The invention relates to a facility for the liquefaction of hydrogen in a cryogenic liquefied-hydrogen store, via a downstream end of a circuit for hydrogen that is to be cooled, the cryogenic store being equipped with a withdrawing pipe configured to allow liquefied hydrogen to be supplied to at least one tank that is to be filled, particularly a mobile tank, the facility comprising a set of heat exchangers in a heat exchange relationship with the circuit for the hydrogen that is to be cooled, and a cooling device in a heat exchange relationship with the set of heat exchangers, said
(Continued)

cooling device comprising a refrigerator with a cycle-gas refrigeration cycle, the facility comprising at least a first pipe for recovering boil-off gas, comprising a first end intended to be connected to a tank and a second end connected to the downstream end of the circuit for the hydrogen that is to be cooled, said first recovery pipe comprising at least a cryogenic compressor and a portion in a heat exchange relationship with at least a part of the set of heat exchangers, the first recovery pipe being configured to recover the boil-off hydrogen, compress it and then cool it and mix it with the liquefied hydrogen at the downstream end of the hydrogen circuit.

14 Claims, 1 Drawing Sheet

(52) U.S. Cl.
CPC ..... *F25J 1/0254* (2013.01); *F25J 1/0072* (2013.01); *F25J 1/0208* (2013.01); *F25J 2230/08* (2013.01); *F25J 2230/32* (2013.01); *F25J 2245/90* (2013.01); *F25J 2270/16* (2013.01); *F25J 2290/62* (2013.01)

(56) References Cited

U.S. PATENT DOCUMENTS

| | | | | |
|---|---|---|---|---|
| 11,680,746 | B2 | 6/2023 | Allidieres et al. | |
| 2009/0199579 | A1* | 8/2009 | Kundig | F25J 1/0007 62/115 |
| 2016/0313057 | A1* | 10/2016 | Roberts | F25J 1/0278 |
| 2017/0227283 | A1* | 8/2017 | Kennedy | F25J 1/0025 |
| 2019/0204007 | A1* | 7/2019 | Ducote, Jr. | F25J 1/0219 |
| 2021/0131726 | A1* | 5/2021 | Kim | F25J 1/0224 |
| 2021/0341221 | A1* | 11/2021 | Mak | F25J 1/005 |
| 2022/0221220 | A1* | 7/2022 | Thomas | F25J 1/0035 |

OTHER PUBLICATIONS

Berstad, et al, "Large-scale hydrogen liquefier utilizing mixed-refrigerant pre-cooling," International Journal of Hydrogen Energy, vol. 35, No. 10, May 1, 2010, pp. 4512-4523.

Quack, H., "Conceptual Design of a High Efficiency Large Capacity Hydrogen Liquefier," AIP Conference Proceedings, American Institute of Physics, vol. 47, No. 1, Jul. 16, 2001, pp. 255-263.

French Search Report for FR 2 107 411, mailed Mar. 24, 2022.

* cited by examiner

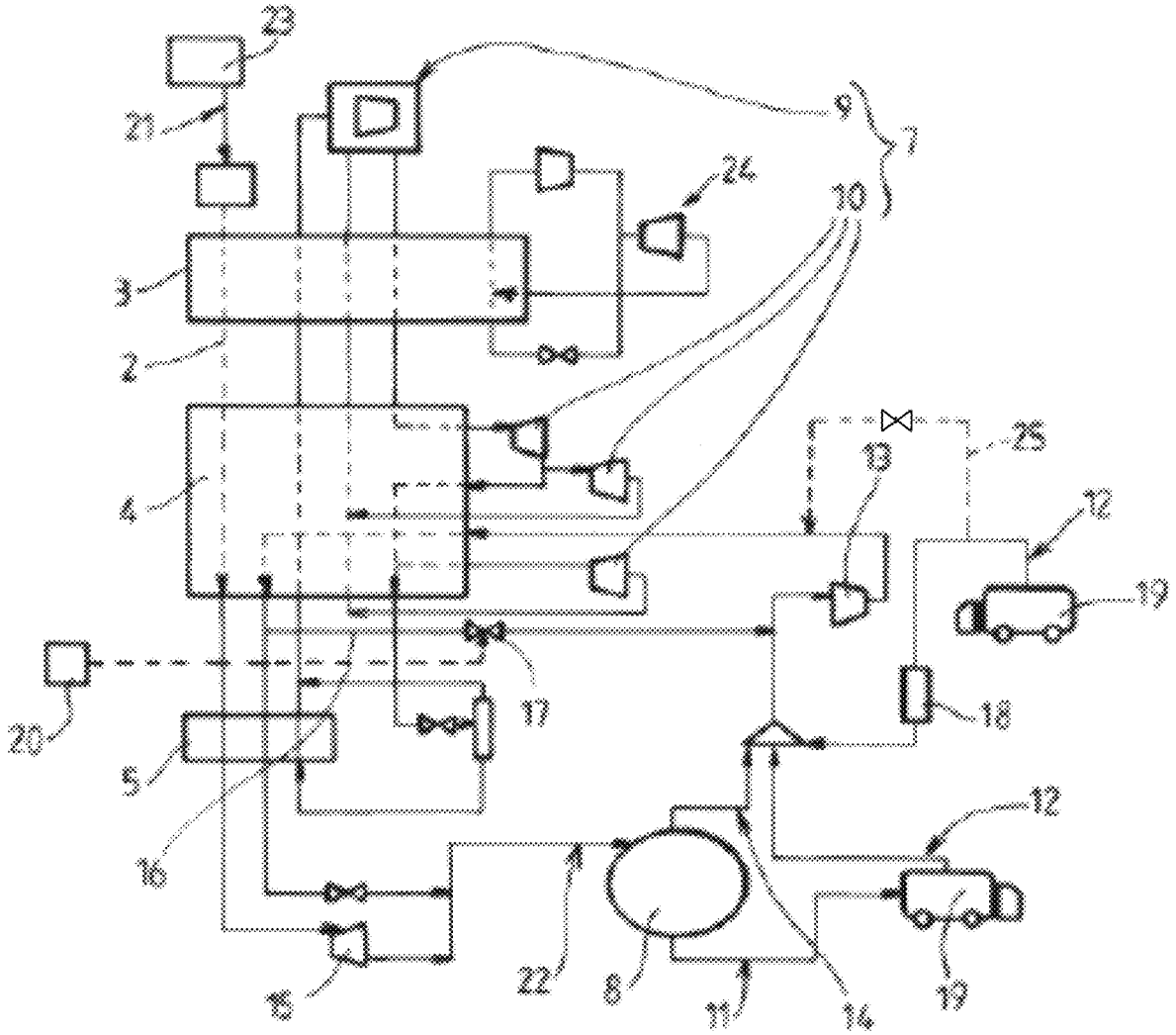
23
21
9
7
24
10
3
2
4
25
13
12
19
20
17
18
5
16
12
15
22
8
11
14
19

FACILITY AND METHOD FOR THE LIQUEFACTION OF HYDROGEN

CROSS REFERENCE TO RELATED APPLICATIONS

This application is a § 371 of International PCT Application PCT/EP2022/066597, filed Jun. 17, 2022, which claims the benefit of FR2107411, filed Jul. 8, 2021, both of which are herein incorporated by reference in their entireties.

FIELD OF THE INVENTION

The invention relates to a facility and a method for the liquefaction of hydrogen.

BACKGROUND OF THE INVENTION

The liquefaction of hydrogen in a liquefaction facility generally uses a stream of gaseous hydrogen under pressure at a pressure of typically between 10 and 30 bar absolute.

In order to reach its liquefaction temperature, this stream can undergo a step of pre-cooling by heat exchange with a first refrigeration cycle. This first refrigeration cycle can use a refrigerant such as nitrogen and/or a refrigerant composed of a mixture ("MR" for "mixed refrigerant").

The stream to be liquefied is then cooled in a cold box to a liquid state by a refrigeration cycle using a refrigerant composed of or comprising helium and/or hydrogen. It should be noted that one or more intermediate cooling step(s) may optionally be provided between the above-mentioned pre-cooling and cooling.

The liquid hydrogen that is produced is typically transferred into at least one cryogenic storage unit which is used, for example, to fill mobile tanks (trucks or other mobile tanks, for example).

One problem with this type of facility is the management of the boil-off gases ("BOG").

The cryogenic storage unit is a first potential source of boil-off gases of the previously liquefied hydrogen. The storage unit for liquefied hydrogen generally produces a relatively constant stream of boil-off gases at relatively low pressure and relatively low temperature (typically around 20K but potentially much higher), which is the result of thermal inputs at said storage unit. This stream may intermittently be increased considerably by the piston effect of the liquid coming from the liquefier, in the case where little or no liquid is extracted from the storage unit.

Recycling of these boil-off gases is generally carried out in the refrigeration cycle with hydrogen (at relatively low pressure) and under cold conditions (that is to say the hydrogen molecules and their frigories are recycled) when the differential pressure between the pressure in the cryogenic storage unit and the refrigeration cycle is sufficient and the valves for redistribution of cold gas have been provided at the liquefaction plant.

Another solution consists in suppressing or reducing that stream of boil-off gases by producing sub-cooled liquid hydrogen at the outlet of the liquefier (in particular in the configuration which uses a helium-based refrigeration cycle).

The tanks which are to be filled with the liquid hydrogen produced by the facility are another source of boil-off gas. Indeed, these mobile tanks or containers for liquid hydrogen generally generate boil-off gases at relatively low or moderate pressure (typically between 7 and 1.1 bara) and at slightly higher temperatures (typically between 20 and 40K, or even just above 40K). This other source of boil-off gas is more discontinuous and even very variable in terms of quantity and thermodynamic conditions depending on the state of the tanks. The boil-off gases recovered from this second source of boil-off gas are generally reheated to around ambient temperature and are recycled in the refrigeration cycle with hydrogen. When the differential pressure between the pressure of these gases and the cycle is sufficient, this recycling can be carried out without additional equipment provided for that purpose. Otherwise, additional equipment is necessary (for example a blower such as a cryogenic ejector, a booster, a compressor, etc.).

When the refrigerant constituting the cycle gas is not pure hydrogen (helium or other gas(es), for example), it is not possible to recycle the gaseous boil-off hydrogen in the cycle (risk of contamination of the refrigerant). In this case, boil-off gases must be avoided (by producing sub-cooled liquid hydrogen) or recovered using ambient temperature compression equipment.

Management of the boil-off gases is therefore problematic.

An objective of the present invention is to eliminate all or some of the above-described disadvantages of the prior art.

SUMMARY OF THE INVENTION

In certain embodiments, the invention relates more particularly to a facility for the liquefaction of hydrogen comprising a circuit for hydrogen to be cooled which comprises an upstream end for connection to a hydrogen source and a downstream end connected to at least one cryogenic storage unit for liquefied hydrogen, the cryogenic storage unit being equipped with an extraction line configured to allow liquefied hydrogen to be supplied to at least one tank to be filled, especially a mobile tank, the facility comprising a set of heat exchanger(s) in a heat exchange relationship with the circuit for hydrogen to be cooled, the facility comprising a cooling device in a heat exchange relationship with the set of heat exchanger(s), said cooling device comprising a refrigerator having a cycle of refrigerating a cycle gas in a working circuit, the cycle gas comprising at least one from among: hydrogen, helium, the working circuit of the refrigerator comprising a member for compression of the cycle gas, a member for cooling of the cycle gas, a member for expansion of the cycle gas and a member for reheating the cycle gas, the facility comprising at least a first line for recovery of boil-off gas comprising a first end for connection to a tank.

In an effort to overcome the deficiencies of the prior art discussed, supra, the facility according to the invention, which is otherwise in accordance with the generic definition given thereof in the preamble above, the first recovery line for recovery of boil-off gas can include a second end connected to the downstream end of the circuit for hydrogen to be cooled, said first recovery line comprising at least one cryogenic compressor and a portion in a heat exchange relationship with at least part of the set of heat exchanger(s), the first recovery line being configured to allow vaporized hydrogen to be recovered, compressed and then cooled and mixed with the liquefied hydrogen at the downstream end of the hydrogen circuit.

In addition, embodiments of the invention can comprise one or a plurality of the following characteristics:

- the portion of the first recovery line that is in a heat exchange relationship with at least part of the set of heat exchanger(s) comprises at least one dedicated passage for the boil-off gas in the heat exchanger(s), said passage being disposed in parallel with a cooling passage for the hydrogen circuit in the exchanger, the facility comprises a second line for recovery of boil-off gas comprising a first end connected to the cryogenic storage unit (8) and a second end connected to the downstream end of the circuit for hydrogen to be cooled, said second recovery line comprising a cryogenic compressor and a portion in a heat exchange relationship with at least part of the set of heat exchanger(s), the second recovery line being configured to allow vaporized hydrogen to be recovered, compressed, cooled and then mixed with the liquefied hydrogen at the downstream end, the first and second lines for recovery of boil-off gas have a common portion downstream of their first ends, and in particular the first and second lines for recovery of boil-off gas share the same common cryogenic compressor and the same passage in the set of heat exchanger(s) forming the portion in a heat exchange relationship, and the same second end, the circuit for hydrogen to be cooled comprises, downstream of the last heat exchange with the set of heat exchanger(s), at least one final expansion member, for example a turbine or an expansion valve, the second end of the first line for recovery of boil-off gas being connected downstream of the final expansion member, that is to say between the final expansion member and the cryogenic storage unit, the facility comprises a bypass line of the cryogenic compressor comprising a first end connected to the at least first recovery line downstream of the cryogenic compressor and downstream of a portion in a heat exchange relationship with at least part of the set of heat exchanger(s), the bypass line comprising a second end connected to a suction inlet of the cryogenic compressor, the facility comprising a member for regulating the flow rate of fluid in the bypass line configured to control the stream of boil-off gas reinjected into the cryogenic compressor, the facility comprises a member for piloting the flow rate regulating member in order to maintain the pressure or the flow rate at the suction inlet of the cryogenic compressor above a specified value, the first recovery line comprises, between its first end and the cryogenic compressor, at least one from among: a member for analyzing the composition of the boil-off gas and especially a device for measuring impurity/impurities, a member for purifying the boil-off gas configured to remove at least one impurity, the first recovery line comprises a plurality of cryogenic compressors disposed in series and/or in parallel, the facility comprises a bypass line provided between the recovery line on the one hand and a set of valve(s) provided to regulate the stream of gas that is or is not allowed to pass through the bypass line, the step of compressing the boil-off gas using the at least one cryogenic compressor of the facility, when the pressure and/or the flow rate at the intake of said cryogenic compressor is below a specified threshold, the method comprising a step of recirculating at least part of the stream of compressed boil-off gas to the intake of the cryogenic compressor.

The invention relates also to a method for the liquefaction of hydrogen using a facility according to one of the characteristics above or below, comprising a step of recovering boil-off gas within at least one cryogenic hydrogen tank, a step of compressing the recovered boil-off gas, a step of cooling the compressed gas, and a step of transferring the cooled gas to the cryogenic storage unit.

According to other possible distinguishing features:

the method comprises a step of recovering boil-off gas from the cryogenic storage unit, a step of compressing the recovered boil-off gas, a step of cooling the compressed gas, and a step of transferring the cooled gas to the cryogenic storage unit, the boil-off gas recovered in the recovery step has a pressure of between 1 and 7 bar absolute and preferably between 1 and 2 bar absolute and a temperature of between 20K and 50K, the boil-off gas, in the compression step, the pressure of the boil-off gas is increased to reach a value of between 1.3 and 6 bara and especially 2 bara and an increased temperature, for example by from 5 to 10K.

The invention can also relate to any alternative device or method comprising any combination of the characteristics above or below within the context of the claims.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

Further particular features and advantages will become apparent upon reading the following description, which is provided with reference to the figures, in which:

The FIGURE represents a diagrammatic and partial view illustrating the structure and the operation of an example of a facility according to the invention.

DETAILED DESCRIPTION OF THE INVENTION

The illustrated facility 1 for the liquefaction of hydrogen comprises a circuit 2 for hydrogen to be cooled comprising an upstream end 21 for connection to a source 23 of gaseous hydrogen. The source 21 can supply, for example, a stream of pure and dry gaseous hydrogen at ambient temperature and having a pressure of between 10 and 80 bar absolute, for example.

The circuit 2 for hydrogen to be cooled has at least one downstream end 22 connected to at least one cryogenic storage unit 8 for liquefied hydrogen in order to store therein the liquefied hydrogen that is produced.

The cryogenic storage unit 8 is, for example, an insulated cryogenic tank under vacuum which stores the liquefied hydrogen, for example, at a pressure of about 1.5 bar absolute and at a temperature of around 20K.

The cryogenic storage unit 8 can be equipped with an extraction line 11 or orifice which is configured to allow liquefied hydrogen to be supplied to one or more tanks 19 which are to be filled, especially one or more mobile tanks. This transfer of liquefied hydrogen can be carried out by differential pressure and/or gravity and/or via a transfer member such as a pump, for example.

The facility 1 comprises a set of heat exchanger(s) 3, 4, 5 in a heat exchange relationship with the circuit 2 for hydrogen to be cooled, and a cooling device in a heat exchange relationship with the set of heat exchanger(s) 3, 4, 5 for cooling the hydrogen circuit 2.

The cooling device comprises at least one refrigerator 7 having a cycle of refrigerating a cycle gas in a working circuit, the cycle gas comprising at least one from among: hydrogen, helium. The working circuit of the refrigerator 7 comprises a member 9 for compression of the cycle gas (one or more compressors, for example), a member 3, 4 for cooling the cycle gas (one or more cooling heat exchangers, for example), a member 10 for expansion of the cycle gas (one or more turbine(s) and/or expansion valve(s)) and a member 5, 4, 3 for reheating the cycle gas (one or more heat exchangers). Reheating and cooling can especially be effected at least in part by countercurrent exchangers 3, 4, 5 in which two separate portions of the cycle gas circulate under different thermodynamic conditions (especially temperature).

That is to say, the working circuit of the refrigerator 7 is configured to subject the working gas to a thermodynamic cycle which produces, at one end of the working circuit, a cooling capacity which is transferred to the circuit 2 to be cooled via one or more heat exchangers.

As is illustrated diagrammatically, upstream of its cooling by the refrigerator 7, the hydrogen circuit 2 can be pre-cooled to an intermediate temperature (for example around 80K) before its liquefaction. This pre-cooling can be carried out by at least one pre-cooling device 24 by heat exchange with a heat exchanger set 3 for pre-cooling. For example, the pre-cooling device 24 comprises a refrigeration cycle using a refrigerant such as nitrogen and/or a refrigerant composed of a mixture ("MR" for "mixed refrigerant"). Of course, any other type of pre-cooling device 24 can be envisaged, such as, for example, a stream of cold fluid, a source of liquefied gas such as nitrogen, for example.

The facility 1 further comprises at least a first line 12 for recovery of boil-off gas (hydrogen) comprising a first end for connection to at least one (especially mobile) tank 19 to be filled and a second end connected to the downstream end 22 of the circuit 2 for hydrogen to be cooled.

This first recovery line 12 comprises at least one cryogenic compressor 13 and, downstream of the cryogenic compressor 13, a portion in a heat exchange relationship with at least part of the set of exchanger(s) 3, 4, 5 in the cold box.

This first recovery line 12 is configured to allow vaporized hydrogen to be recovered, compressed and then cooled (especially liquefied) and mixed with the liquefied hydrogen produced at the downstream end 22 of the hydrogen circuit 2.

As illustrated, the first recovery line 12 can have a portion in a heat exchange relationship with one or more of the set of exchanger(s) 3, 4, 5 cooled by the refrigerator 7.

That is to say, for example, the first recovery line 12 in a heat exchange relationship with at least part of the set of heat exchanger(s) 3, 4, 5 can comprise at least one dedicated passage for the boil-off gas in the heat exchanger(s) 3, 4, 5. This or these passages can be disposed in parallel with a cooling passage for the hydrogen circuit 2 in the exchanger 4, 5. For example, the vaporized hydrogen circulates in a dedicated passage in parallel with a stream of the circuit 2 for hydrogen to be liquefied, for example between that stream of a stream of the hydrogen circuit 2 and a stream of cycle gas. The exchanger or exchangers 4, 5 are, for example, plate or other exchangers, comprising dedicated passages for these different streams of fluid. The dedicated passages can have one or more catalytic sections for the conversion of ortho hydrogen into para hydrogen.

For example, the first recovery line 12 can recover vaporized hydrogen from a tank 19 at a pressure of between 1.1 bar absolute and 10 bar absolute and especially 5 bar and at a temperature of between 20 and 40K, for example 35K, and at a flow rate which can be of the order of 1000 $Nm^3/h$.

The cryogenic compressor 13 is configured to compress a stream of cryogenic gas and, for example, to produce a stream of gaseous hydrogen at a pressure which is sufficient to overcome the pressure losses of the downstream circuit, that is to say, for example, approximately 2 bar absolute starting from a stream of vaporized gases at a pressure of the order of 1.3 bar absolute, for example.

For example, the pressure of the stream of boil-off gas at the inlet of the cryogenic compressor 13 can be between 1.0 and 2.0 bar absolute, and preferably between 1.0 and 1.5 bar absolute, whereas, at the outlet of the compressor, that pressure of the gas can be, for example, between 1.3 and 6 bar absolute and preferably between 1.3 and 2.5 bar absolute.

The cryogenic compressor can be a compressor of the centrifugal or volumetric type.

As illustrated by broken lines, a bypass line 25 can be provided between, on the one hand, at least a first recovery line 12 (or the outlet of the tank 19) and, on the other hand, the downstream end of the compressor 13. This allows the compressor 13 to be discharged when it does not need to be used if the boil-off gas is at a sufficient pressure. A set of valve(s) (not shown for the sake of simplicity) can be provided for regulating the stream of gas that is or is not allowed to pass through the bypass line 25. The method can thus comprise a step in which at least part of the vaporized hydrogen bypasses the compressor 13 when it is at a pressure greater than a specified level.

Thus, the boil-off gases from the tank or tanks 9 can be recycled directly in the cold state (typically at temperatures of between 50K and 20K) via a cryogenic compressor 13, whatever the liquefaction cycle. These boil-off gases are compressed and therefore optionally reheated slightly (for example up to +5 to 10K by the effect of quasi-adiabatic compression, depending on the capacity of the cryogenic compressor 13). The cold and compressed boil-off gases are then introduced into one or more dedicated passages of the main exchange line of the refrigerator in order to be cooled in parallel with the line for hydrogen to be liquefied. This stream of cooled gaseous hydrogen (which especially may be at least partially liquefied) is then mixed with the stream of liquefied hydrogen of the circuit 2.

This structure allows the boil-off gases from tanks 19 (especially trucks), which can be variable over time and in terms of temperature conditions as well as in terms of the flow rate to be treated, to be efficiently recovered and recycled.

As illustrated, the circuit 2 for hydrogen to be cooled can comprise, downstream of the last heat exchanger 5 of the set of heat exchanger(s), a final expansion member 15, for example a turbine or an expansion valve (for example of the Joule-Thomson type). The second end of the first line 12 for recovery of boil-off gas is preferably connected downstream of the final expansion member 15, that is to say between the final expansion member 15 and the cryogenic storage unit 8.

The cooled boil-off hydrogen which is mixed with the liquefied hydrogen of the circuit 2 can be substantially liquid (optionally partially two-phase: liquid-gas).

The facility 1 can be provided for likewise recycling the boil-off gases of the cryogenic storage unit 8 for liquefied hydrogen according to the same principle (compression, cooling, and then mixing with the liquefied hydrogen that is produced). To this end, the facility 1 can comprise at least a second recovery line 14 equipped with a first end connected to the cryogenic storage unit 8 and a second end connected to the downstream end 22 of the circuit 2 for hydrogen to be cooled.

As illustrated, this second recovery line 14 and the first recovery line 12 can share the cryogenic compressor 13 and the portion in a heat exchange relationship which have been described above. That is to say, the first 12 and second 14 lines for recovery of boil-off gas can have separate upstream ends but can share the same common portion downstream of their first ends. In particular, the boil-off gases collected in the first 12 and second 14 lines for recovery of boil-off gas preferably share the same cryogenic compressor 13 and use the same passage in the set of heat exchanger(s) 3, 4, 5 for their cooling.

That is to say, the boil-off gases of the tanks 19 and of the storage unit 8 can be recovered and mixed in a common collector which feeds the inlet of the cryogenic compressor 13.

Such a facility 1 advantageously allows the boil-off gases of mobile tanks 19 and/or of the storage unit 8 to be recovered and recycled simultaneously and/or sequentially by adapting to streams that are variable both in terms of quantity and in terms of temperature and pressure conditions.

Of course, the facility 1 can be configured to permit the recovery of boil-off gases from a plurality of tanks 19 simultaneously (and/or sequentially). Thus, the facility 1 can have a plurality of first recovery lines 12 (or a first recovery line 12 comprising a plurality of first ends).

Likewise, the facility 1 can be configured to permit the recovery of boil-off gases from a plurality of storage units 8, where applicable.

As illustrated diagrammatically, the first recovery line 12 can have, between its first end and the inlet of the cryogenic compressor 13, at least one from among: a member 18 for analyzing the composition of the boil-off gas and especially a device for measuring impurity/impurities, a member 18 for purifying the boil-off gas configured to remove at least one impurity. For example, this analysis and/or purification can be carried out on connection of the tank 19.

As illustrated diagrammatically, the facility 1 can comprise a bypass line 16 of the cryogenic compressor 13 allowing at least part of the compressed stream to be recycled to the suction intake of the cryogenic compressor 13 in order to ensure a minimum pressure or flow rate at the suction intake.

This bypass line 16 has a first end connected to the recovery line 12, 14, for example downstream of a portion in a heat exchange relationship with at least part of the set of heat exchanger(s) 3, 4, 5. The bypass line 16 comprises a second end connected to the suction intake of the cryogenic compressor 13.

The facility 1 further comprises a member 17 for regulating the flow rate of fluid in the bypass line 16, configured to control the flow of boil-off gas reinjected into the cryogenic compressor 13 in order to maintain the pressure or the flow rate at the suction intake of the cryogenic compressor 13 above a specified value. This regulating member 17 can comprise or be composed of a set of valve(s), for example.

Thus, when there is little or insufficient boil-off gas (for example below a minimal charging flow rate required to supply the cryogenic compressor 13), a portion of the gaseous hydrogen is removed in order to allow the cryogenic compressor 13 to operate under its optimal conditions and avoid premature wear and especially shutdown of the cryogenic compressor 13 when it is under-supplied.

This cryogenic bypass flow (when it is necessary) is therefore preferably cooled in the line of exchangers at 4, 5 of the cycle before being reinjected at the suction intake of the compressor 13. When the flow rate of boil-off gas is sufficient, the bypass can be interrupted and the performance of the cryogenic compressor 13 can be controlled (piloted) by the flow rate to be treated (directly or indirectly), that is to say the cryogenic compressor 13 can be controlled or piloted as a function of the pressure at its inlet. As shown diagrammatically, the regulating member 17 can be piloted by a programmable electronic controller 20 which can comprise a microprocessor. This controller 20 can be part of the compressor 13, where applicable.

Of course, the invention is not limited to the examples described below. Thus, for example, the device 1 can comprise a plurality of cryogenic compressors 13 disposed in series and/or in parallel in the recovery line. In particular, a plurality of cryogenic compressors disposed in series (with or without intermediate cooling of the compressed stream) allow the rate of compression to be increased.

Likewise, the facility 1 can have an intermediate gas storage unit (buffer) for storing the boil-off gas at a cryogenic temperature level, upstream of the suction intake of the cryogenic compressor 13 in order to decorrelate the functioning of the compressor from the variable returns of boil-off gas.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A facility for the liquefaction of hydrogen, comprising:

a circuit configured to cool hydrogen that comprises an upstream end that is configured to connect to a hydrogen source and a downstream end that is in fluid communication with a cryogenic storage unit for liquefied hydrogen, wherein the cryogenic storage unit being equipped with an extraction line configured to allow liquefied hydrogen to be supplied to at least one tank to be filled;

a set of heat exchanger(s) in a heat exchange relationship with the circuit;

a cooling device in a heat exchange relationship with the set of heat exchanger(s), said cooling device comprising a refrigerator having a cycle of refrigerating a cycle gas in a working circuit, the cycle gas comprising at least one from among: hydrogen, helium, the working circuit of the refrigerator comprising a compressor configured to compress the cycle gas, a cooling heat exchanger passage configured to cool the cycle gas, a turbine or valve configured to expand the cycle gas, and a reheating heat exchanger passage configured to repeat the cycle gas;

a first recovery line configured to recover boil-off gas comprising a first end and a second end connected to the downstream end of the circuit for hydrogen to be cooled, said first recovery line comprising a cryogenic compressor and a portion in a heat exchange relationship with at least part of the set of heat exchanger(s), the first recovery line being configured to allow the boil-off gas to be recovered, compressed and then cooled and mixed with the liquefied hydrogen at the downstream end of the hydrogen circuit, a first bypass line comprising a first end connected to the first recovery line downstream of the cryogenic compressor and downstream of the portion in a heat exchange relationship with at least part of the set of heat exchanger(s), the first bypass line comprising a second end that is connected to a suction inlet of the cryogenic compressor; and a valve configured to regulate the flow rate of fluid in the bypass line configured to control the stream of boil-off gas reinjected into the cryogenic compressor.

2. The facility according to claim 1, wherein the portion of the first recovery line that is in a heat exchange relationship with at least part of the set of heat exchanger(s) comprises at least one dedicated passage for the boil-off gas in the set of heat exchanger(s), said at least one dedicated passage being disposed in parallel with a cooling passage for the hydrogen circuit in the set of heat exchanger(s).

3. The facility according to claim 1, further comprising a second recovery line configured to recover a second boil-off gas, the second recovery line comprising a first end connected to the cryogenic storage unit and a second end connected to the downstream end of the circuit for hydrogen to be cooled, said second recovery line comprising a portion in a heat exchange relationship with at least part of the set of heat exchanger(s), the second recovery line being configured to allow the second boil-off gas to be recovered, compressed, cooled and then mixed with the liquefied hydrogen at the downstream end.

4. The facility according to claim 3, wherein the first and second recovery lines for recovery of the boil-off gas and the second boil-off gas have a common portion downstream of their first ends, such that the first and second recovery lines share the cryogenic compressor and the same-passage in the set of heat exchanger(s) forming the portion in a heat exchange relationship, and the same second end.

5. The facility according to claim 1, wherein the circuit for hydrogen to be cooled comprises, downstream of the last heat exchange with the set of heat exchanger(s), at least one final expansion member, which comprises a final turbine or a final expansion valve, and in that the second end of the first line for recovery of boil-off gas is connected downstream of the final expansion member and upstream the cryogenic storage unit.

6. The facility according to claim 1, further comprising a piloting member configured to pilot the flow rate regulation member in order to maintain the pressure or the flow rate at the suction inlet of the cryogenic compressor above a specified value.

7. The facility according to claim 1, wherein the first recovery line comprises, between the first end and the cryogenic compressor, at least one from among: an analyzer configured to analyze a composition of the boil-off gas, configured to measure, a purifier configured to purify the boil-off gas by removing at least one impurity.

8. The facility according to claim 1, wherein the first recovery line comprises a plurality of cryogenic compressors disposed in series and/or in parallel.

9. The facility according to claim 1, further comprising a second bypass line provided between the first end of the first recovery line and a downstream end of the cryogenic compressor, wherein the bypass line further comprises a set of valve(s) configured to regulate the stream of gas that is or is not allowed to pass through the bypass line.

10. A method for the liquefaction of hydrogen using the facility as claimed in claim 1, the method comprising the steps of: wherein boil-off gas the first recovery line is configured to recover includes boil-off gas within the at least one tank to be filled, recovering the boil-off gas within the at least one tank to be filled using the first recovery line; compressing the recovered boil-off gas in the cryogenic compressor; cooling the compressed gas in the set of heat exchanger(s); and transferring the cooled gas to the cryogenic storage unit.

11. The method as claimed in claim 10, further comprising the steps of: recovering boil-off gas from the cryogenic storage unit; compressing the recovered boil-off gas; cooling the compressed gas; and transferring the cooled gas to the cryogenic storage unit.

12. The method as claimed in claim 10, wherein the boil-off gas recovered in the recovery step has a pressure of between 1 and 7 bar absolute and a temperature of between 20K and 50K.

13. The method as claimed in claim 10, wherein, in the compression step, the pressure of the boil-off gas is increased to reach a value of between 1.3 and 6 bara and an increased temperature.

14. The method as claimed in claim 10, wherein during the step of compressing the recovered boil-off gas using the cryogenic compressor of the facility, when the pressure and/or the flow rate at the intake of said cryogenic compressor is below a specified threshold, the method comprises a step of recirculating at least part of the stream of compressed boil-off gas to the intake of the cryogenic compressor.

* * * * *